US005566862A

United States Patent [19]

Haffner et al.

[11] Patent Number: 5,566,862

[45] Date of Patent: Oct. 22, 1996

[54] LIQUID CONTAINING AND DISPENSING PACKAGE

[75] Inventors: Eugene F. Haffner, Maumee, Ohio; Thomas P. Royce, Rockingham, N.C.; John M. Shingle, Maumee, Ohio

[73] Assignee: Owens-Illinois Closure Inc., Toledo, Ohio

[21] Appl. No.: 327,950

[22] Filed: Oct. 24, 1994

[51] Int. Cl.[6] ..... B67D 1/16

[52] U.S. Cl. ..... 222/111; 222/109; 222/143; 222/424; 222/478; 222/571

[58] Field of Search ..... 222/109, 111, 222/143, 424, 478, 567, 568, 571

[56] References Cited

U.S. PATENT DOCUMENTS

| | | | |
|---|---|---|---|
| 3,217,935 | 11/1965 | Burt | 222/109 |
| 3,300,104 | 1/1967 | Burt | 222/482 |
| 3,833,150 | 9/1974 | Visser-Patings | 222/109 |
| 4,078,700 | 3/1978 | Hidding | 222/109 |
| 4,298,145 | 11/1981 | Iida | 222/478 |
| 4,427,138 | 1/1984 | Heinlein | 222/546 |
| 4,550,862 | 11/1985 | Barker | 222/109 |
| 4,706,829 | 11/1987 | Li | 215/354 |
| 4,756,433 | 7/1988 | Lin | 215/6 |
| 4,890,770 | 1/1990 | Haga et al. | 222/109 |
| 4,917,268 | 4/1990 | Campbell | 222/109 |
| 5,020,692 | 6/1991 | Darr | 222/109 |
| 5,020,699 | 6/1991 | Sams | 222/109 X |
| 5,058,772 | 10/1991 | Moore | 222/109 |
| 5,131,566 | 7/1992 | Bavegems | 222/109 X |
| 5,207,356 | 5/1993 | Krall | 222/109 |
| 5,251,788 | 10/1993 | Moore | 222/111 |
| 5,435,467 | 7/1995 | Ekkert et al. | 222/109 |

*Primary Examiner*—Joseph A. Kaufman

[57] ABSTRACT

In accordance with the invention, a liquid dispensing fitment for use on a container having a neck comprises a plastic body which has an inner wall defining an axial spout extending from within the neck of a container and axially beyond the end of the neck. The body has an outer annular wall spaced from the spout and connected to the spout by an integral annular connecting portion. The spout extends axially beyond the outer wall and has an upper generally C-shaped cross section defining an opening and a lower annular cross section. The annular connecting portion is inclined with respect to the axis of the spout and has its lowermost portion aligned with the opening of the C-shaped portion of said spout. The outer wall has an axial opening extending from a position aligned with the juncture of the C-shaped portion and annular portion of the spout through the annular connecting portion to define a combined drain back opening and a near empty pour out hole. The fitment is provided with threads on the upper end of the outer wall for engaging the neck of a container. The lower portion of the spout is substantially smooth in an axial direction to facilitate drain back. The lower portion of the spout has an inner surface formed with an integral axial rib aligned with the axial opening in the outer wall to facilitate manufacture. The outer wall has the portion of the outer wall containing the near empty opening such that it is radially offset from the portion of the outer wall axially below the near empty opening thereby facilitating manufacture of the fitment.

5 Claims, 3 Drawing Sheets

LIQUID CONTAINING AND DISPENSING PACKAGE

This invention relates to liquid containing and dispensing packages and particularly to such packages which include a pouring spout and a closure that functions as a measuring cup.

BACKGROUND AND SUMMARY OF THE INVENTION

In one type of liquid dispensing package, a pouring spout fitment is positioned on the neck of the container and a closure in the form of the cup is interengaged with the periphery of the container. More specifically, a spout is mounted in a first fitment that is on a container. The fitment has internal threads which are engaged by the external threads of a cover.

In U.S. Pat. No. 4,706,829, there is disclosed a liquid containing and dispensing package comprising a hollow plastic container having a neck, a fitment interengaging the neck and a closure. The fitment interengages the neck and as a first peripheral portion extending axially and having a portion defining a spout having a pouring lip extending axially inwardly of the end of the neck, and a closure comprising a top wall and a first peripheral wall extending from the top wall axially inwardly. The closure includes a radial portion extending from the peripheral wall and sealingly engaging an annular area of the fitment. The closure defines a dispensing cup and includes a second outer peripheral wall spaced from the first peripheral wall which has internal threads engaging external threads on the neck of the container.

Among the objectives of the present invention are to provide a liquid containing package wherein the spout fitment or insert has improved moldability in larger size spouts; and wherein the plastic fitment or insert can be made with simplified tooling without negative draft.

In accordance with the invention, a liquid dispensing fitment for use on a container having a neck comprises a plastic body which has an inner wall defining an axial spout extending from within the neck of a container and axially beyond the end of the neck. The body has an outer annular wall spaced from the spout and connected to the spout by an integral annular connecting portion. The spout extends axially beyond the outer wall and has an upper generally C-shaped cross section defining an opening and a lower annular cross section. The annular connecting portion is inclined with respect to the axis of the spout and has its lowermost portion aligned with the opening of said C-shaped portion of said spout. The annular wall has a drain opening therethrough. The outer wall has a near empty pour out opening extending from a position aligned with the juncture of the C-shaped portion and annular portion of the spout. The fitment is provided with means on the upper end of the outer wall for engaging the neck of a container. The outer wall has the portion of the outer wall containing the near empty opening such that it is radially offset from the portion of the outer wall axially below the near empty opening thereby facilitating manufacture of the fitment. The lower portion of the spout is substantially smooth in an axial direction to facilitate drain back. The lower portion of the spout has an inner surface formed with an integral axial rib aligned with the openings in the ,outer wall to facilitate manufacture.

DESCRIPTION OF THE PREFERRED EMBODIMENTS

Figure 1:
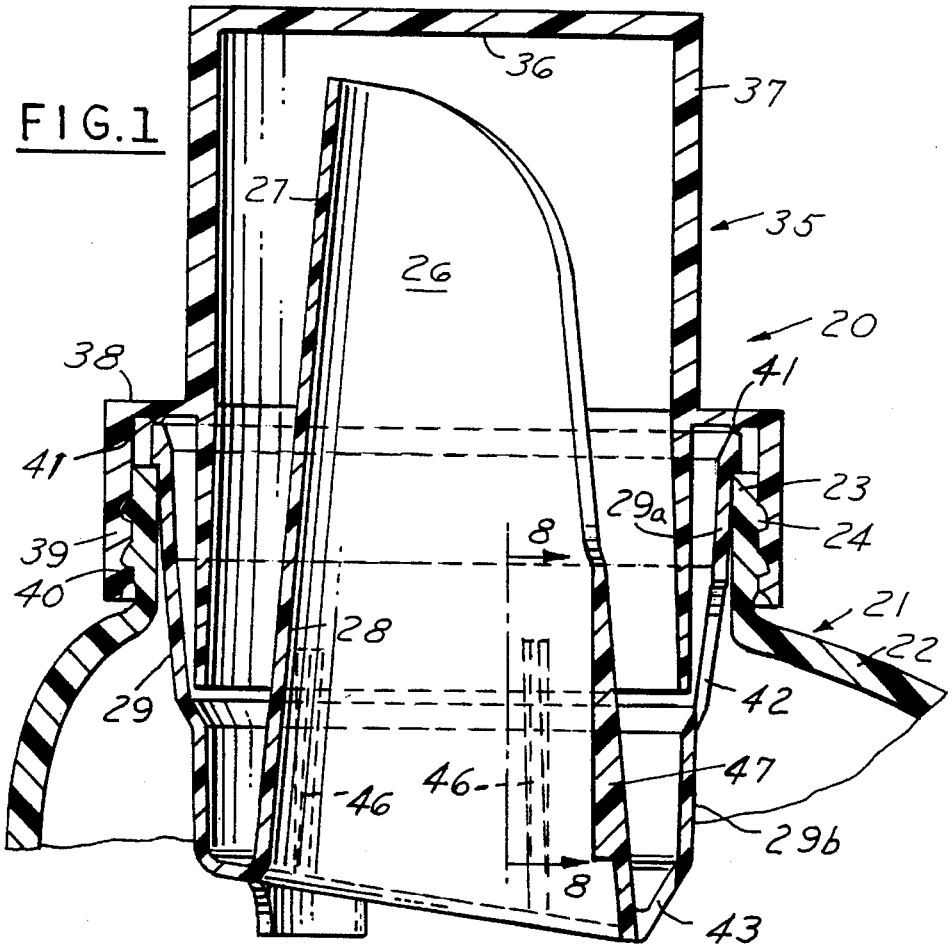
FIG. 1 is a fragmentary sectional view of a liquid containing and dispensing package embodying the invention.

In accordance with the invention, the container package 20 comprises a hollow plastic container 21 having a body 22 and a neck 23. The neck 23 is formed with external threads 24. The package 20 further includes a fitment or insert 25 that comprises a centrally disposed inner spout portion 26 that has an arcuate upper portion 27 which is generally C-shaped in transverse cross-section. The spout 26 has an annular lower portion 28. The fitment 25 further includes an outer wall portion 29 interconnected to the lower portion 28 by an annular portion 30 and extending generally upwardly and outwardly. The outer wall portion 29 further includes a peripheral flange 31 adapted to engage the upper surface of the neck 23.

The package 20 further includes a closure 35 that is generally cylindrical including a top or base wall 36 and a peripheral wall 37. The peripheral wall 37 extends downwardly within the wall of the spout 26. The cap 35 further includes an annular wall 38 ! extending radially outwardly intermediate the ends of the peripheral wall 37 and an annular axial skirt 39 extending downwardly and having internal threads 40 engaging the external threads 24 on the neck 32.

The annular wall 38 of the closure includes an annular downwardly extending annular projection in the form of a bead 41, preferably having a V cross-section, that engages the fitment 25 to provide a primary seal between the closure 35 and the fitment 25 and, in turn, force the fitment 25 against the end of the neck 23.

The fitment 25 includes a near empty pour out opening 42 extending from a position aligned with the juncture of the C-shaped portion 27 and annular lower portion 28 of the spout. The fitment 25 further includes a drain back opening 43. The outer wall 29 has the portion **29*a* of the outer wall containing the near empty opening 42 such that it is radially offset from the portion 29*b* of the outer wall axially below the near empty opening 42** thereby facilitating manufacture of the fitment.

The container 21 may be made of plastic material such as high density pollyethylene. The fitment 25 may be made of other plastic materials, for example, such as low density polyethylene and the closure 35 may be made of plastic material such as polypropylene.

Figure 5:
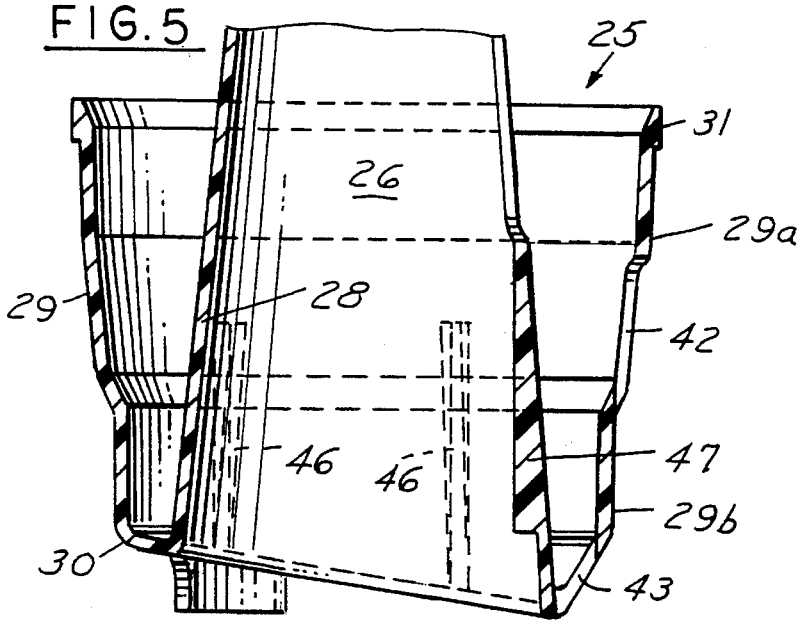
FIG. 5 is a fragmentary sectional view taken along the line 5—5 in FIG. 3.
Figure 3:
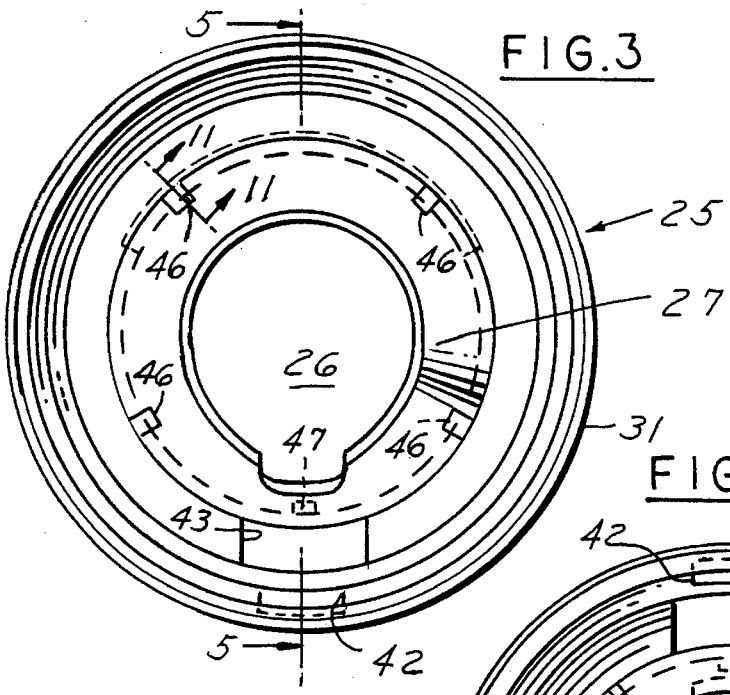
FIG. 3 is a top plan view of the fitment.
Figure 4:
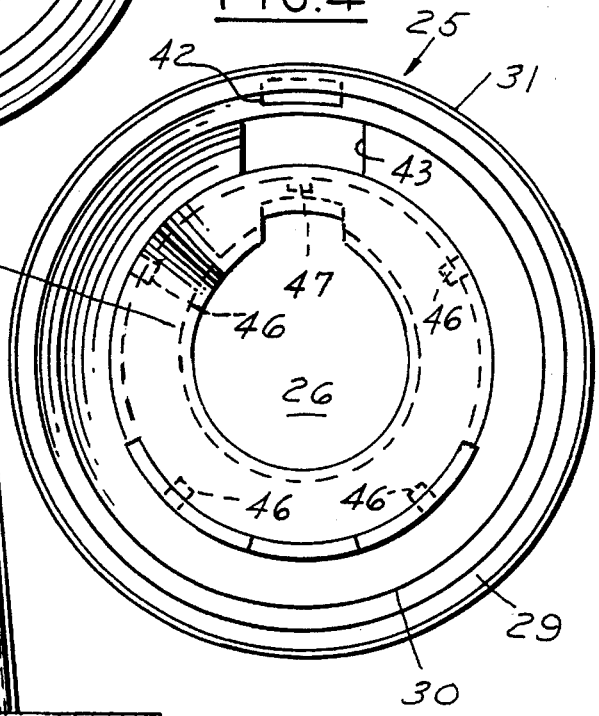
FIG. 4 is a bottom plan view of the fitment.
Figure 2:
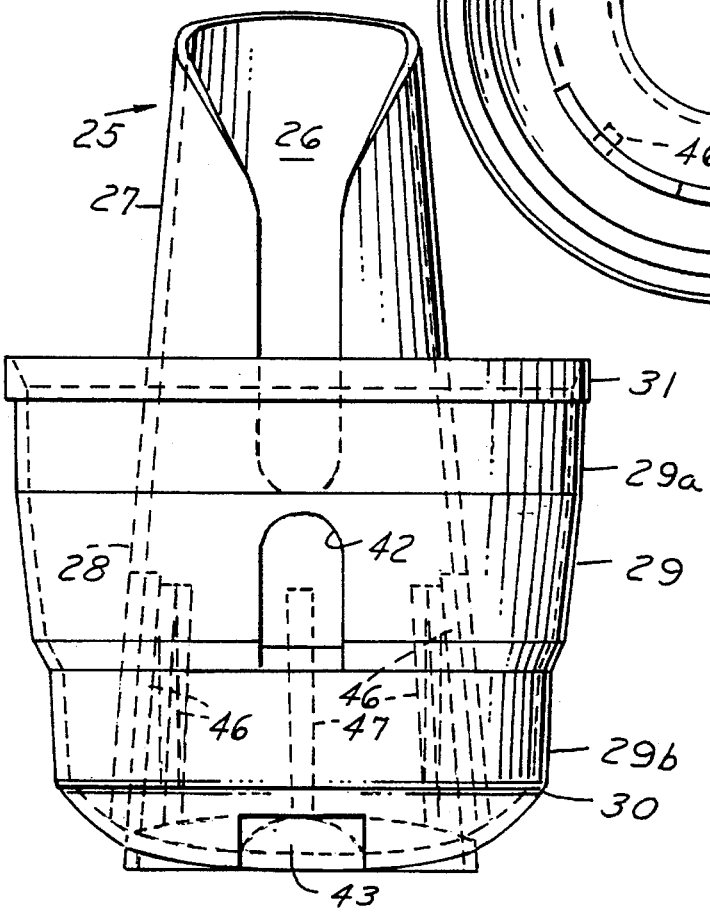
FIG. 2 is an elevational view of the fitment as viewed from the right in FIG. 1.
Figure 6:
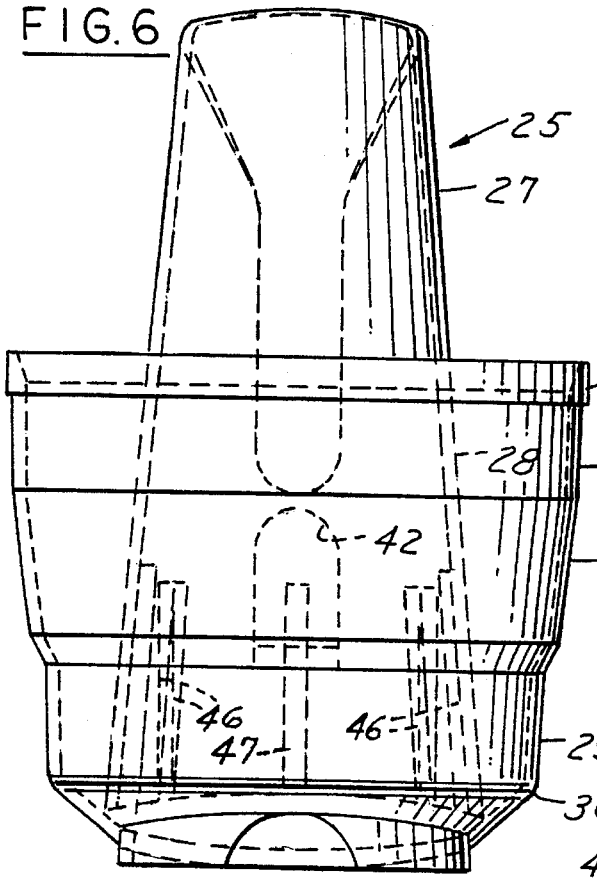
FIG. 6 an elevational view of the fitment taken from the left in FIG. 1.
Figure 10:
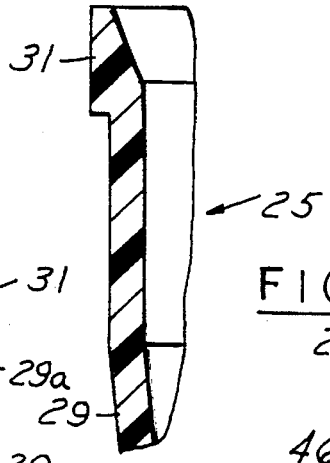
FIG. 10 is a fragmentary sectional view on an enlarged scale of a portion of the upper and of the fitment.
Figure 11:
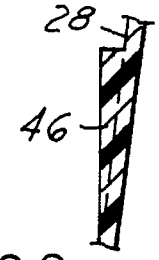
FIG. 11 is a sectional view taken along the line 11—11 in FIG. 3
Figure 8:
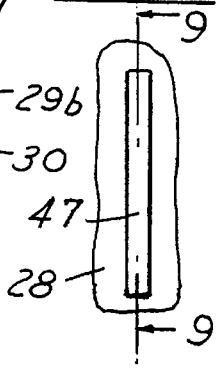
FIG. 8 is a fragmentary sectional view taken along the line 8—8 in FIG. 1.
Figure 9:
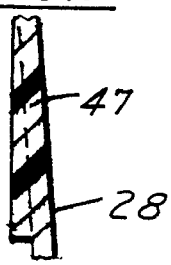
FIG. 9 is a fragmentary sectional view taken along the line 9—9 in FIG. 8.
Figure 7:
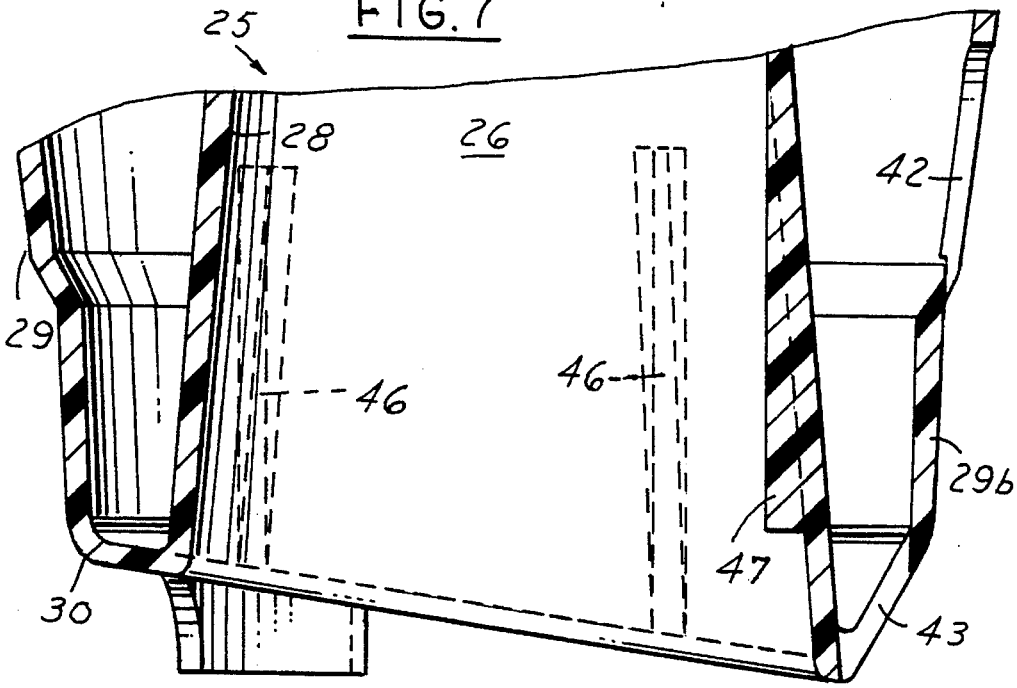
FIG. 7 is a fragmentary view on an enlarged scale of the lower portion of the fitment shown in FIG. 5.

The fitment 25 further includes circumferential spaced vertical ribs .46 on the outer surface of the lower portion 28 (FIGS. 5,–11) and a single vertical rib 47 on the inner surface of the lower portion 28 opposite the opening 42 (FIGS. 5, 8, and 9).

The vertical ribs 46 facilitate stacking of the fitments. First, after the parts are manufactured, they are stacked one on top of the other, about twenty (20) high. These stacks are then placed on their side in the shipping cartons, and multiple stacks laid upon each other. This method of packaging greatly improves the efficiency of the cartons. The vertical rib 46 prevents the spouts in stacks from being compressed too much. If the vertical ribs were not included as shown, the parts which have multiple tapered surfaces, could be stacked so tightly together, that the equipment used to pick and place the spouts into the container would malfunction. The function of the rib 47 is utilized with the machinery used to place the spout.

In particular, the single, a symmetrical rib 47 is used for orienting the spout relative to the container, so that the spout is aligned with the front of the container opposite the handle of the container.

It can thus be seen that there has been provided a liquid containing package wherein the spout fitment or insert has improved moldability in larger size spouts; and wherein the plastic fitment or insert can be made with simplified tooling without negative draft.

It can thus be seen that there has been provided a liquid containing package fitment for use on a container having a neck comprises a plastic body which has an inner wall defining an axial spout extending from within the neck of a container and axially beyond the end of the neck. The body has an outer annular wall spaced from the spout and connected to the spout by an integral annular connecting portion. The spout extends axially beyond the outer wall and has an upper generally C-shaped cross section defining an opening and a lower annular cross section. The annular connecting portion is inclined with respect to the axis of the spout and has its lowermost portion aligned with the opening of said C-shaped portion of said spout. The annular wall has a drain opening therethrough. The outer wall has a near empty pour out opening extending from a position aligned with the juncture of the C-shaped portion and annular portion of the spout., The fitment is provided with means on the upper end of the outer wall for engaging the neck of a container, The outer wall has the portion of the outer wall containing the near empty opening such that it is radially offset from the portion of the outer wall axially below the near empty opening thereby facilitating manufacture of the fitment, The lower portion of the spout is substantially smooth in an axial direction to facilitate drain back, The lower portion of the spout has an inner surface formed with an integral axial rib aligned with the openings in the outer wall to facilitate manufacture.

What is claimed is:

1. A liquid dispensing fitment for use on a container, the container having a neck, the fitment comprising a plastic body, said body having an inner wall defining an axial spout extending from within the neck of the container and axially beyond the end of the neck, said inner wall having a lower end, said body having an outer annular wall spaced from said spout and said outer annular wall having a lower end, an integral annular connecting portion interconnecting said lower end of said inner wall and said lower end of said outer annular wall, said connecting portion having a drain back opening, said spout extending axially beyond said outer wall, said spout having an arcuate upper portion which is generally C-shaped in transverse cross section defining an opening, said spout having a lower annular portion, said annular connecting portion being inclined with respect to the axis of the spout and having its lowermost portion aligned with said opening of said C-shaped portion of said spout, said outer annular wall including an upper portion having a near empty pour out opening aligned with the juncture of the C-shaped portion and the annular portion of said spout, said upper portion of said outer annular wall which contains said near empty opening being radially offset with respect to the lower portion of the outer wall which is axially below said near empty opening thereby facilitating manufacture of said fitment, and means on said upper end of said outer wall for engaging the neck of the container.

2. The liquid dispensing fitment set forth in claim 1 wherein said lower portion of said spout is substantially smooth in an axial direction to facilitate drain back.

3. The liquid dispensing fitment set forth in claim 2 wherein said lower portion of said spout has an inner surface formed with an integral axial rib aligned with said axial opening in said outer wall to facilitate manufacture.

4. The liquid dispensing fitment set forth in any one of claims 1–3 wherein said fitment as positioned in a finish with means on said upper end of said outer wall of said body engaging said neck to define a liquid dispensing package.

5. The liquid dispensing package set forth in claim 4 including a closure having means thereon engaging means on said finish of said container.

* * * * *